US010311688B1

(12) United States Patent
Tirado

(10) Patent No.: US 10,311,688 B1
(45) Date of Patent: Jun. 4, 2019

(54) SYSTEM FOR ALERTING AND GUIDING RESCUE PERSONNEL TO A BUILDING

(71) Applicant: Micheline Tirado, Naples, FL (US)

(72) Inventor: Micheline Tirado, Naples, FL (US)

( * ) Notice: Subject to any disclaimer, the term of this patent is extended or adjusted under 35 U.S.C. 154(b) by 0 days.

(21) Appl. No.: 16/003,208

(22) Filed: Jun. 8, 2018

(51) Int. Cl.

| | |
|---|---|
| ***G08B 7/06*** | (2006.01) |
| ***H05B 37/02*** | (2006.01) |
| ***E04D 13/00*** | (2006.01) |
| ***F21S 8/02*** | (2006.01) |
| ***F21V 33/00*** | (2006.01) |
| ***F21V 23/04*** | (2006.01) |

(52) U.S. Cl.
CPC ..... *G08B 7/064* (2013.01); *E04D 13/00* (2013.01); *F21S 8/024* (2013.01); *F21S 8/026* (2013.01); *F21V 23/045* (2013.01); *F21V 33/006* (2013.01); *G08B 7/062* (2013.01); *G08B 7/066* (2013.01); *H05B 37/0272* (2013.01)

(58) Field of Classification Search
CPC ..... H05B 37/0272; H05B 33/0803; H05B 37/00; H05B 33/0857; F21S 6/00; F21S 2/00; F21S 4/00; F21S 4/10; F21S 8/028; F21W 2121/00; F21W 2121/004; F21W 2121/006; G02B 6/0041; G02B 6/0046; G02B 6/0055; G02B 6/0068; G06F 9/54; G08B 7/062; G08B 7/066; G08C 17/02; G08C 2201/30; G09F 13/0409; G09F 13/22; H01Q 1/06; H01Q 1/244; H01Q 1/362; H01Q 1/38; H04B 1/40; H04L 12/2814; H04L 12/282; H04L 2012/2841; H04L 2012/285; H04L 67/125; H04W 4/70; Y02B 20/445; Y04S 40/18; A63J 1/00; B60P 3/0252; F21K 9/232; F21K 9/27; F21K 9/66; F21V 17/007; F21V 21/15; F21V 23/008; F21V 23/0435; F21V 23/045; F21V 29/773; F21V 21/30; F21V 23/0442; F21V 33/0056; F21V 33/006; F21Y 2103/10; F21Y 2113/13; F21Y 2115/10; E04D 13/158; Y10S 362/802

See application file for complete search history.

(56) References Cited

U.S. PATENT DOCUMENTS

| | | | | |
|---|---|---|---|---|
| 5,140,301 | A | 8/1992 | Seidenko | |
| 2004/0105255 | A1* | 6/2004 | Seeburger | E04D 13/158 362/145 |
| 2006/0215958 | A1* | 9/2006 | Yeo | G02B 6/0041 385/31 |

(Continued)

*Primary Examiner* — Dionne Pendleton
(74) *Attorney, Agent, or Firm* — Sanchelima & Associates, P.A.; Christian Sanchelima; Jesus Sanchelima

(57) ABSTRACT

A system to alert and guide rescue personnel to a building is disclosed. The system is installed at a rooftop or sidewall of the building. The system comprises a sensor to detect fire in the building. Upon sensing, the sensor sends signal to a controller to activate an illuminating unit and a display unit. Subsequently, the controller instructs the illuminating unit and the display unit to pop out of the rooftop or sidewall of the building. Concurrently, the controller instructs a transceiver to send an alert to emergency personnel. When the emergency personnel try to reach the building, the emergency personnel can use the visual indication provided by the illuminating unit and display unit to identify the building and reach the building to rescue occupants of the building.

9 Claims, 5 Drawing Sheets

(56) References Cited

U.S. PATENT DOCUMENTS

| | | | | |
|---|---|---|---|---|
| 2010/0110668 | A1* | 5/2010 | Marlonia | F21V 21/15<br>362/152 |
| 2012/0277010 | A1* | 11/2012 | Bilsen | A63J 1/00<br>472/75 |
| 2013/0014448 | A1* | 1/2013 | Jones | A47G 7/045<br>52/11 |
| 2018/0276960 | A1* | 9/2018 | Thornton | G08B 7/062 |

* cited by examiner

SYSTEM FOR ALERTING AND GUIDING RESCUE PERSONNEL TO A BUILDING

BACKGROUND OF THE INVENTION

1. Field of the Invention

The present disclosure generally relates to an assisting system. In particular, the present disclosure relates to a system to alert and guide rescue personnel to a building in case of an emergency.

2. Description of the Related Art

It is known that several systems are used to detect an emergency event in a building such as fire, earthquake and so on. Typically, the system may include sensors such as fire detectors, seismic detectors positioned throughout the building. Signals generated from the sensors are monitored by a controller, which will sound alarm or display lights at appropriate places in the building indicating the emergency event to occupants of the building. The lights may include flashlights placed at EXIT doors or on floor or ceiling to guide the occupants towards EXIT. The lights may be used to guide the occupants to a safe exit from the building.

Examples of the systems used for guiding the occupants to a safe exit in the building is disclosed in at least a United States Granted patent U.S. Pat. No. 5,140,301 and a United States patent application 20120092183. In U.S. Pat. No. 5,140,301, a guidance apparatus comprising a laser emitting a laser beam used to guide the occupants towards emergency exit of the building is disclosed. In US20120092183, an emergency lighting device for providing a directional indication on a recipient surface with first and second guidance indication light sources retained relative to a housing to emit beams of light, each with a directional indication, onto a recipient surface is disclosed.

Although the systems disclosed in the art provides solution to alert and guide the occupants of the building in case of an emergency event, there are several problems associated with the systems disclosed above. It should be noted that all the systems disclosed are installed indoors. It is known that in case of fire, the systems are configured to alert emergency personnel such as fire safety personnel, police, ambulance and so on. However, when the emergency personnel try to reach the building that requires assistance, it is difficult for them to identify the building. This is particularly relevant when the emergency is needed in high-rise buildings. Much of the time is wasted in identifying the floor in which the assistance is needed. Further, it is difficult to identify the building in a locality if the emergency event takes place inside of the building, which does not have any indication to direct the emergency/rescue personnel to the building. None of the above systems disclose a way in which the emergency/rescue personnel can be directed to the appropriate building or floor that requires assistance in case of the emergency.

Other documents describing the closest subject matter provide for a number of more or less complicated features that fail to solve the problem in an efficient and economical way. None of these patents suggest the novel features of the present invention. Specifically, none of the disclosures in the art disclose a system that is installed at rooftops or sidewalls of a building that can alert and guide the emergency/rescue personnel in case of an emergency to the building.

Therefore, there is a need in the art for a system to alert and guide emergency personnel to a building in case of an emergency to the building.

SUMMARY OF THE INVENTION

It is one of the main objects of the present invention to provide a system to alert and guide emergency personnel to a building in case of an emergency and avoids the drawbacks of the prior art.

It is one object of the present invention to provide a system installed at a rooftop/sidewall of a building to provide a visual indication to emergency personnel to identify and reach the building in case of an emergency.

It is one object of the present invention to provide a system to alert and guide emergency personnel to a building. The system is installed at a rooftop or sidewall of the building. The system comprises a sensor, a controller, an illuminating unit, a display unit and a transceiver. The sensor is used to detect an emergency event such as fire in the building. Upon sensing, the sensor sends signal to the controller to activate the illuminating unit and/or the display unit. When activated, the illuminating unit and the display unit pop out of the rooftop or sidewall of the building. The display unit is configured to display number of the building. The illuminating unit is configured to provide light beam of different colors. Concurrently, the controller instructs the transceiver to send an alert to emergency personnel/control server. When rescue personnel try to reach the building, the rescue personnel use the visual indication provided by the illuminating unit and the display unit to identify the building and reach the building.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses a system to alert and guide emergency/rescue personnel to a building. The system may be installed at a rooftop or sidewall of the building. The system comprises a sensor to detect fire in the building. Upon sensing, the sensor sends signal to a controller to activate an illuminating unit and a display unit. Subsequently, the controller instructs the illuminating unit and the display unit to pop out of the rooftop or sidewall of the building. The illuminating unit is configured to provide light beam of different colors. The display unit is configured to display number of the building. Concurrently, the controller instructs a transceiver to send an alert to emergency personnel. For example, the transceiver sends alert to police personnel or fire department. When rescue personnel try to reach the building, the rescue personnel can use the visual indication provided by the illuminating unit and the display unit to identify the building and reach the building to rescue occupants of the building.

Various features and embodiments of a system to alert and guide emergency/rescue personnel to a building are explained in conjunction with the description of FIGS. 1-5.

Figure 1:
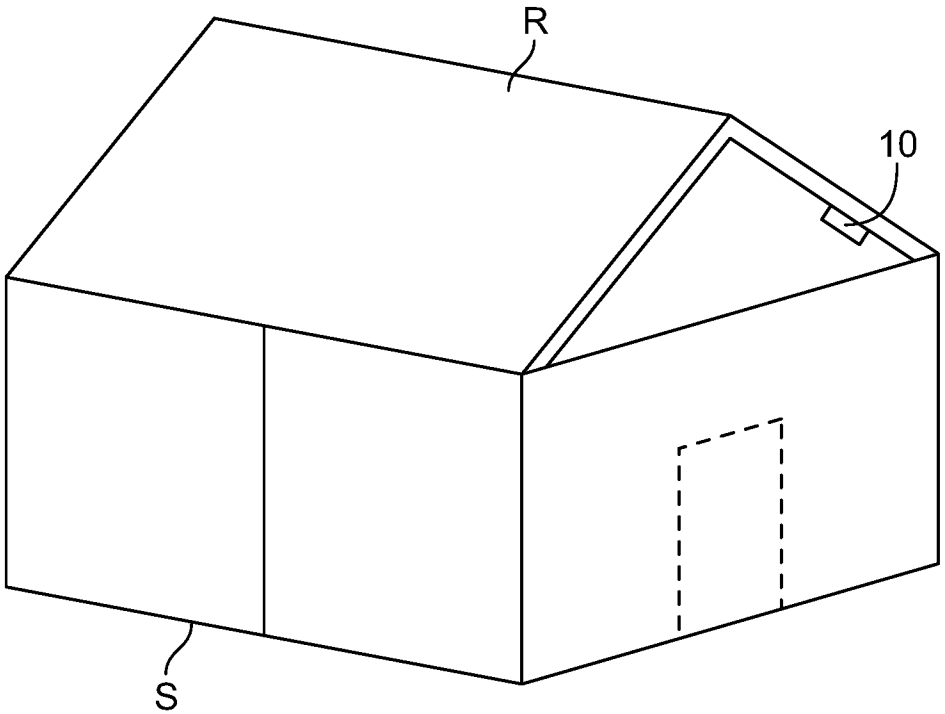
FIG. 1 illustrates a schematic diagram of a system 10 installed at rooftop of a building S, in accordance with one embodiment of the present disclosure.
Figure 2:
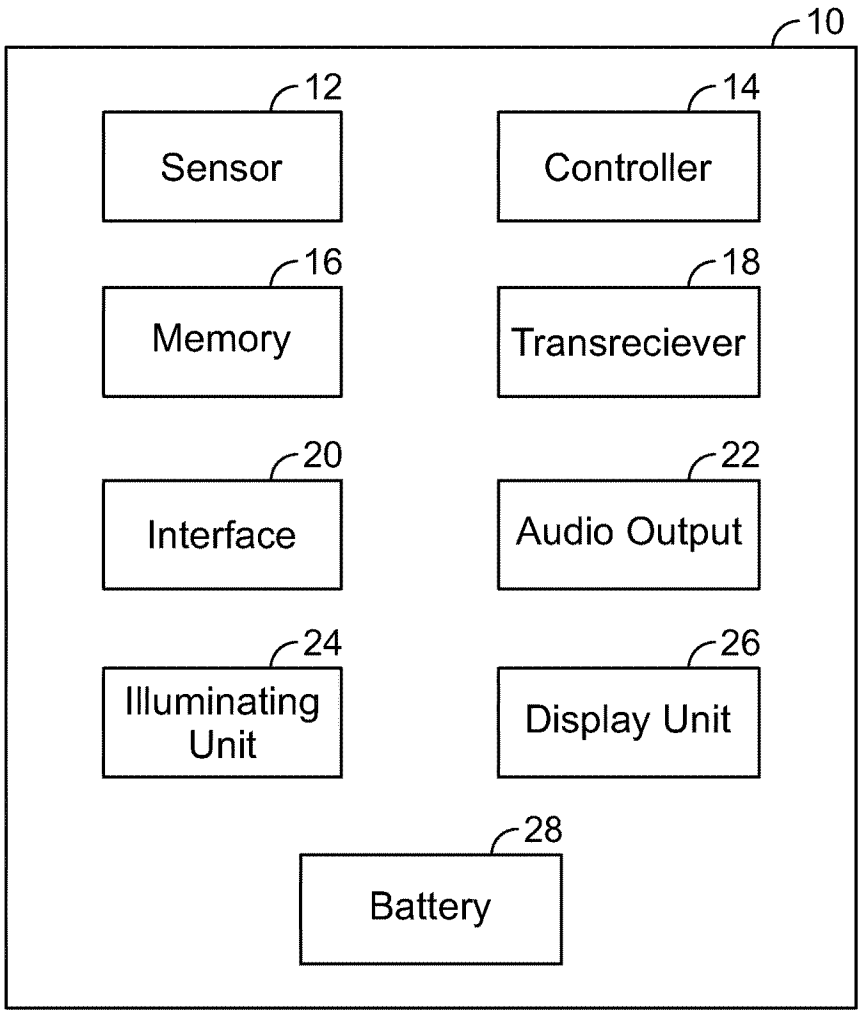
FIG. 2 illustrates the system 10, in accordance with one embodiment of the present disclosure.
Figure 3:
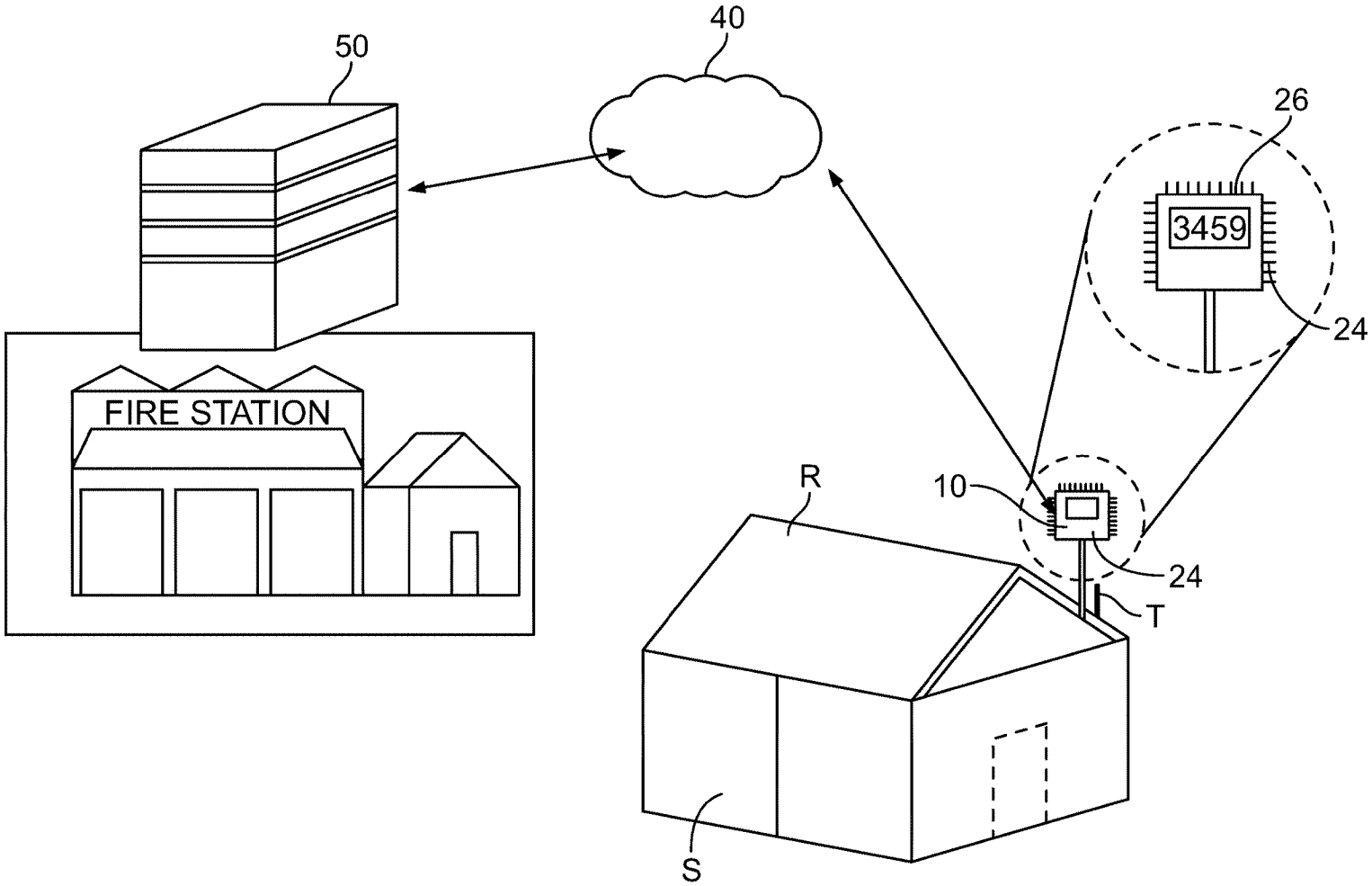
FIG. 3 illustrates a schematic diagram of the system 10 used to provide visual indication of the building S and alerting emergency personnel/control server 50, in accordance with one embodiment of the present disclosure.

Referring to FIGS. 1, 2 and 3, a system 10 for alerting and guiding emergency/rescue personnel to a building S is disclosed. The system 10 is provided at a building S. Preferably, the system 10 is provided at a rooftop R of the building S. In one example, the system 10 is provided at a sidewall of the building S. It should be understood that the system 10 is provided at the sidewall in case the building S is a tall structure having multiple stories. It should be understood that the system 10 is placed in the building S in such a way that the system 10 is generally not visible from outside, as shown in FIG. 1. As known, the rooftop R may be provided with a roof tile T to cover the building S at the top. When the system 10 detects an emergency event such as a fire accident, then the system 10 becomes visible from outside. Specifically, the system 10 pops out of the roof tile T and becomes visible from outside, as shown in FIG. 3.

Referring to FIG. 2, the system 10 is explained. The system 10 may be provided in various shapes and sizes. The system 10 comprises a sensor 12. The sensor 12 may include, but not limited to, a fire detector, theft alert sensor, and so on. The system 10 comprises a controller 14, a memory 16, a transceiver 18, an interface 20, an audio output 22, an illuminating unit 24, a display unit 26, and a battery 28.

The controller 14 may be implemented as one or more microprocessors, microcomputers, digital signal processors, central processing units, state machines, logic circuitries, and/or any devices that manipulate signals based on operational instructions. Among other capabilities, the controller 14 is configured to fetch and execute computer-readable instructions or program instructions stored in the memory 16.

The memory 16 may include any computer-readable medium known in the art including, for example, volatile memory, such as static random access memory (SRAM) and dynamic random access memory (DRAM), and/or non-volatile memory, such as read only memory (ROM), erasable programmable ROM, flash memories, hard disks, and so on.

The transceiver 18 is used to transmit and receive signal/data from the system 10 to external devices such as servers or user devices.

The interface 20 may include a variety of software and hardware interfaces, for example, a web interface, a graphical user interface, and the like. The interface 20 may allow the system 10 to interact with a user directly or through user devices (not shown).

The audio output 22 may indicate a speaker to announce instructions provided by the controller 14. The illuminating unit 24 may indicate a signal lamp which has a focused bright beam and is capable of emitting different colors such as red, white, green and so on.

The display unit 26 may include a Light Emitting Diode (LED) screen configured to display messages. The battery 28 is used to power the system 10. The battery 28 may include a rechargeable battery such as Lithium-Ion battery.

Referring to FIGS. 1 and 3, operation of the system 10 to alert and guide emergency/rescue personnel is explained. As explained above, the system 10 is placed in the building S in such a way that the system 10 is generally not visible from outside. In case of the emergency event, such as fire, the sensor 12 detects the fire and sends signal to the controller 14. The controller 14 instructs the illuminating unit 24 to activate and pop out of the building S by opening the roof tile T. Further, the controller 14 instructs the illuminating unit 24 to flash light such that the attention is drawn to the building S. The controller 14 may instruct the illuminating unit 24 to emit light in different colors to indicate different meanings to rescue personnel. Similarly, the controller 14 instructs display unit 26 to activate and pop out of the building S by opening the roof tile T. In one example, the display unit 26 is configured to display a message indicating the emergency event at the building S. It should be understood that a plurality of the messages might be stored in the memory 16. In one example, the message may include address of the building S. In another example, the message may include door number of the building S. In another example, the message may include type of the emergency event occurred in the building S. Based on the incident; the controller 14 may fetch the instructions from the memory 16 and instruct the display unit 26 to display the message as shown in FIG. 3.

Further, the system 10 may send an alert via a network 40 to emergency personnel/control server 50. Specifically, the system 10 may send the alert to the control server 50 using the transceiver 18. The alert may indicate distress signal/emergency event at the building S. The alert may include the message such as the address/door number of the building S.

In one implementation, the network 40 may be a wireless network, a wired network or a combination thereof. The network 40 can be implemented as one of the different types of networks, such as intranet, local area network (LAN), wide area network (WAN), the internet, and the like.

Figure 4:
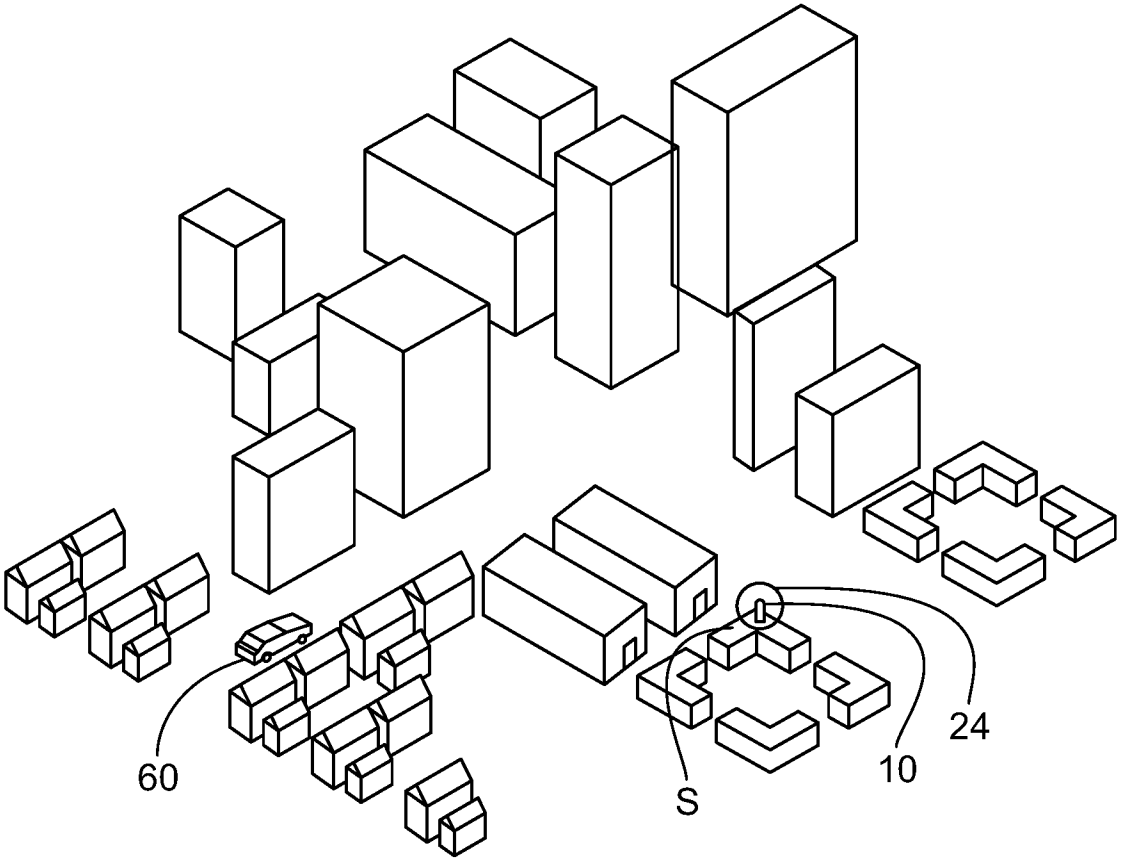
FIG. 4 illustrates a schematic diagram of the system 10 installed on the building S and the system 10 showing a visual indication to guide rescue personnel 60, in accordance with one embodiment of the present disclosure.

Now referring to FIG. 4, the emergency personnel/control server 50 responding to the alert is explained. Upon receiving the alert, the emergency personnel 50 may send a rescue vehicle 60 with rescue personnel to help occupants of the building S. The rescue vehicle 60 may include a police vehicle, an ambulance, a fire engine and so on. When the rescue vehicle 60 approaches vicinity of the building S, the rescue personnel may identify the building S with the help of the illuminating unit 24 emitting light e.g., red light at the rooftop R. Further, the personnel may identify the building S with the help of display unit 26 displaying the message at the rooftop R and reach the building S without any difficulty. Upon reaching the building S, the rescue personnel may rescue the occupants of the building S.

Figure 5:
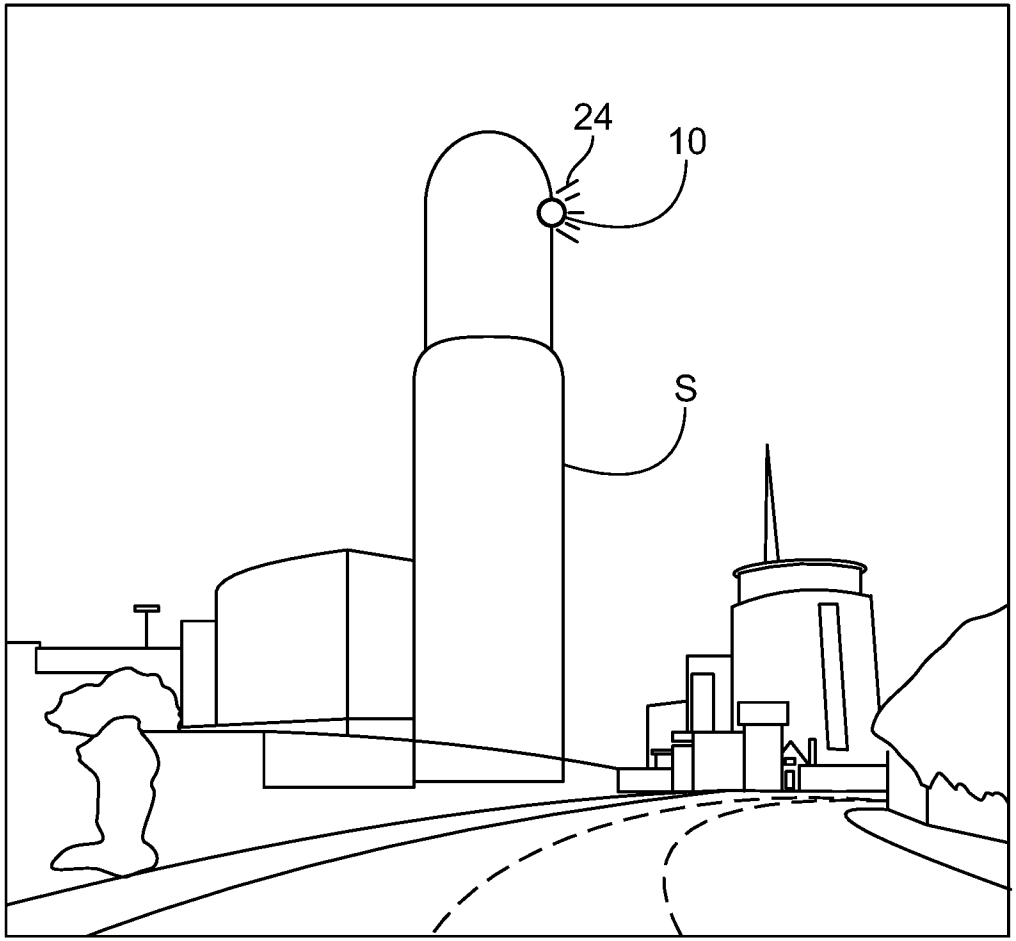
FIG. 5 illustrates a schematic diagram of the system 10 installed on a tall building S, in accordance with one embodiment of the present disclosure.

Referring to FIG. 5, an example illustrating the system 10 implemented at a high-rise building S is shown. The current example is shown to illustrate the system 10 being implemented at the sidewall of the building S. It is known that it is difficult to identify the floor in which the emergency event took place from the ground. In order to overcome the problem of identifying the floor in case of the emergency event, the system 10 may be installed at sidewall of each floor in the building S. In case of an emergency, the system 10 may instruct the illuminating unit 24 and the display unit 26 to pop out of the sidewall. As such, when the rescue vehicle 60 approaches vicinity of the building S, the rescue personnel may identify the floor of the building S with the help of the illuminating unit 24 and the display unit 26 and reach the floor of the building S that requires assistance without any difficulty. In other words, the emergency personnel are guided to the building S with the help of the illuminating unit 24 and the display unit 26. Upon reaching the floor, the rescue personnel may rescue occupants of the building S.

In one implementation, the controller 14 may instruct the audio output 22 to announce the alert indicating of the emergency event at the building S. The alert is announced to draw attention of neighbors to assist the occupants of the building S.

In one example, the sensor 12 may include a switch (not shown) installed at the building S. An occupant of the building S may activate the switch such that an alert is sent to the emergency personnel, such as police. The occupant may activate the switch in situations like theft, domestic violence and so on. Upon activating, the system 10 activates the illuminating unit 24 and the display unit 26 to draw attention to the building S when the rescue personnel approach the building S.

It is evident from the above disclosure that the system can be used to alert and guide the emergency personnel to the building in case of any emergency. The system can be used without the audio output thereby making the system to guide the rescue personnel with only visual indications i.e., with the help of the illuminating unit 24 and the display unit 26.

It should be understood that when the illuminating unit 24 and the display unit 26 are activated in case of an emergency, and the rescue personnel are directed with the help of visual indications. As light beam can reach far distances, with different colors, the rescue personnel can identify the building S from far distances and reach the building S faster.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for alerting and guiding rescue personnel to a building, comprising:

a building having a roof, at least one pop-up illuminating unit, wherein the unit comprises a housing enclosure and is adapted to direct emergency services to a residence, an emergency light providing a visual alert, a sensor, a controller, said sensor adapted to send a signal to the controller to activate said pop-up illuminating unit and a display unit, a transceiver adapted to send an alert to emergency personnel, said display unit has a screen that displays messages from a memory or external device, said display unit having a perimeter, said pop-up illuminating unit mounted entirely along said perimeter, said roof having a plurality of roof tiles, said display unit housed entirely under at least one of said plurality of roof tiles, said display unit pops-up and above said roof using a vertical member comprising a rail or post for actuating upon receiving instructions from said controller.

2. The system of claim 1 including a building having a sidewall and a rooftop, said at least one pop-up illuminating unit is two illuminating lights mounted on the rooftop and the sidewall, respectively.

3. The system of claim 1 wherein said illuminating unit is controlled remotely.

4. The system of claim 1 wherein said building includes a roof, said illuminating unit mounted to said roof.

5. The system of claim 1 wherein said building includes a sidewall, said illuminating unit mounted to said sidewall.

6. The system of claim 1 wherein said building includes a roof, said display unit mounted to said roof.

7. The system of claim 1 wherein said building includes a sidewall, said display unit mounted to said sidewall.

8. The system of claim 1 wherein said building has a roof having roof tiles, at least one roof tile houses said display unit underneath, said display unit connected to said sensor, said roof tile rising using hydraulics or springs upon said sensor being triggered, a motor connected to said hydraulics or said springs to raise said roof tile thereby revealing said display unit.

9. The system of claim 1 wherein said building includes at least one roof tile, said display unit is entirely hidden under said at least one roof tile until said sensor is triggered.

* * * * *